US009397459B2

(12) United States Patent
Butcher et al.

(10) Patent No.: US 9,397,459 B2
(45) Date of Patent: Jul. 19, 2016

(54) MANUAL SERVICE DISCONNECT WITH SCREW COVER

(71) Applicant: Lear Corporation, Southfield, MI (US)

(72) Inventors: Anthony Butcher, Troy, MI (US); David Menzies, Linden, MI (US); Reinhard Pusch, Farmington Hills, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 14/461,004

(22) Filed: Aug. 15, 2014

(65) Prior Publication Data

US 2016/0049761 A1 Feb. 18, 2016

(51) Int. Cl.

| | |
|---|---|
| ***H01R 31/08*** | (2006.01) |
| ***H01R 33/95*** | (2006.01) |
| ***H01H 85/20*** | (2006.01) |
| ***H01H 85/22*** | (2006.01) |
| ***H01H 85/54*** | (2006.01) |
| *H01H 85/02* | (2006.01) |

(52) U.S. Cl.
CPC ..... *H01R 33/95* (2013.01); *H01H 85/204* (2013.01); *H01H 85/22* (2013.01); *H01H 85/54* (2013.01); *H01H 2085/025* (2013.01)

(58) Field of Classification Search
CPC ..... H01H 85/2045
USPC ..... 439/314, 509, 511, 620.34, 911
See application file for complete search history.

(56) References Cited

U.S. PATENT DOCUMENTS 3,141,713 A * 7/1964 Kauffman ..... A47L 15/4259 312/328
3,418,615 A * 12/1968 Canney ..... H01H 85/20 337/190
3,732,516 A * 5/1973 Puetz ..... H01H 9/10 337/194
3,755,772 A * 8/1973 Reed ..... H01R 13/707 439/304
4,473,268 A * 9/1984 Watanabe ..... H01H 85/547 337/215
4,742,434 A * 5/1988 Furui ..... B60Q 1/0088 174/541
5,476,392 A * 12/1995 Inaba ..... B60L 3/00 439/341
5,572,396 A 11/1996 Robinson
5,820,413 A * 10/1998 Yamada ..... H01H 85/201 439/620.26

(Continued)

FOREIGN PATENT DOCUMENTS

EP 2672573 A1 12/2013

OTHER PUBLICATIONS

IBM Technical Disclosure; Safety Plug; Nov. 1976.*

*Primary Examiner* — Neil Abrams
(74) *Attorney, Agent, or Firm* — MacMillan, Sobanski & Todd, LLC

(57) ABSTRACT

A manual disconnect includes a housing and a base attached to the housing by a fastener. The base includes primary terminals. The manual disconnect also includes a plug assembly that includes fuse terminals and a bolt cover. The plug assembly is movable relative to the base between a disconnected position wherein the fuse terminals are not engaged with respective primary terminals, and a primary circuit engaged position, wherein the fuse terminals are engaged with respective primary terminals. When the plug assembly is in the primary circuit engaged position the bolt cover is positioned to prevent the fastener from being removed from the housing. A handle or cover part of the plug assembly is then rotated to a locked position with respect to the base. Then, the plug assembly can be moved further in the insertion direction to close an interlock circuit, allowing current to flow in the primary circuit.

11 Claims, 8 Drawing Sheets

(56) References Cited

U.S. PATENT DOCUMENTS 5,854,580 A * 12/1998 Konda ..... H01H 9/085 335/132
5,971,801 A * 10/1999 Kato ..... B60L 3/0069 439/157
6,056,592 A * 5/2000 Hashizawa ..... H01R 13/701 200/51.09
6,087,737 A * 7/2000 Alksnat ..... B60L 3/04 180/282
6,261,123 B1 * 7/2001 Kruger ..... H01R 13/60 439/484
6,337,448 B1 * 1/2002 Konda ..... H01H 9/085 200/17 R
6,406,310 B2 * 6/2002 Schmid ..... H01R 13/62933 439/157
6,619,970 B2 * 9/2003 Fukushima ..... H01H 9/085 439/157
6,658,204 B2 * 12/2003 Schurter ..... F24H 9/2021 392/441
6,663,405 B1 12/2003 Robinson et al.
6,729,903 B1 * 5/2004 Clark ..... H01R 4/22 439/521
7,044,780 B2 * 5/2006 Ma ..... H01R 13/639 439/553
7,244,148 B2 7/2007 Maguire et al.
7,338,311 B2 * 3/2008 Laschinksi ..... H01R 13/7038 439/441
7,410,020 B2 * 8/2008 Kikuchi ..... H01R 4/44 180/68.5
7,530,850 B2 5/2009 Maguire et al.
7,872,206 B2 * 1/2011 Matsunaga ..... B60L 3/00 200/335
7,893,809 B2 * 2/2011 Head ..... H01H 85/54 337/194
8,192,212 B2 6/2012 Casses et al.
8,460,027 B2 * 6/2013 Topolewski ..... H01R 31/08 439/511
8,466,586 B2 * 6/2013 Tarchinski ..... B60K 6/46 180/65.1
8,562,368 B2 10/2013 Boyer
8,574,004 B1 11/2013 Tarchinski et al.
8,579,655 B2 * 11/2013 Kawamura ..... H01R 13/6315 439/353
8,911,245 B2 * 12/2014 Okamoto ..... H01R 13/62944 439/157
8,986,024 B2 * 3/2015 Ikeda ..... H01L 9/102 200/332
9,004,935 B2 * 4/2015 Lim ..... B60L 3/04 439/347
9,059,533 B2 * 6/2015 Bogart ..... H01H 9/00
9,231,359 B1 * 1/2016 Butcher ..... H01R 33/95
9,260,080 B2 * 2/2016 Maguire ..... B60R 25/40
2014/0127939 A1 * 5/2014 Ishibashi ..... H01R 13/748 439/573
2015/0207130 A1 * 7/2015 Maguire ..... H01M 2/1083 429/97

* cited by examiner

MANUAL SERVICE DISCONNECT WITH SCREW COVER

BACKGROUND OF THE INVENTION

This invention relates in general to structures for interrupting an electric circuit. More specifically, this invention relates to an improved manual disconnect for an electric battery in an electric circuit.

Electric batteries are used to store and supply power for various types of machines. Batteries are often used to provide power to portable electronic equipment. Unlike a power source like a generator, which may be turned off, the battery may continue to supply power as long as there is a closed circuit between its terminals. Typically, when the electronic equipment is serviced, repaired, or inspected, the circuit is opened so that there is no current flow.

Electric vehicles and hybrid vehicles may use high voltage batteries to store electric power. This power can be provided to the vehicle by an external source, such as a wall outlet, or by an internal source such as a gasoline engine or regenerative brakes. The high voltage batteries may be used to provide power to vehicle systems, such as electric drive motors that propel the vehicle. It is sometimes desirable to disconnect the high voltage batteries so that there is no high voltage current provided to any of the vehicle's systems. This can be done to avoid damage to the vehicle systems as well as to avoid injury to people. For example, in order to reduce the risk of electrocution during service of the vehicle, a technician may disconnect the battery. Alternatively, after an accident a first responder may disconnect the battery. Consequently, vehicles that include high voltage batteries may include a manual disconnect to allow the electric circuit including the high voltage batteries to be manually opened. It is desirable to have an improved manual disconnect.

SUMMARY OF THE INVENTION

This invention relates to a manual disconnect for an electric battery in an electric circuit. The manual disconnect includes a housing and a base attached to the housing by a fastener. The base includes primary terminals. The manual disconnect also includes a plug assembly that includes fuse terminals and a bolt cover. The plug assembly is movable relative to the base between a disconnected position, wherein the fuse terminals are not engaged with respective primary terminals, and a primary circuit engaged position, wherein the fuse terminals are engaged with respective primary terminals. When the plug assembly is in the primary circuit engaged position the bolt cover is positioned to prevent the fastener from being removed from the housing.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
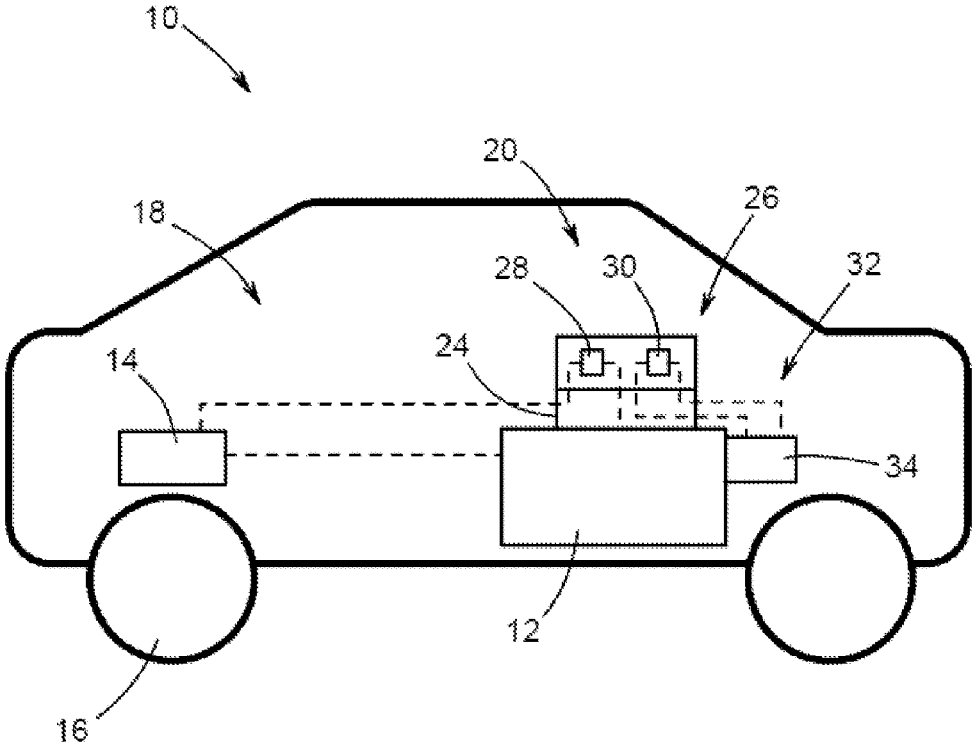
FIG. 1 is a schematic view of an electric vehicle including a high voltage battery with a manual disconnect in accordance with the invention.

Referring now to the drawings, there is illustrated in FIG. 1 a schematic view of an electric vehicle, indicated generally at 10. The illustrated electric vehicle 10 includes a battery 12. The illustrated vehicle 10 is an electric vehicle, but may be a hybrid vehicle or any desired type of vehicle that includes a battery 12. The battery 12 may be a single battery or may be multiple battery cells, if desired. The electric vehicle 10 includes an electric motor 14 that is connected to drive wheels 16. A primary circuit, indicated at 18, provides current flow from the battery 12 through the electric motor 14. The illustrated electric motor 14 is one type of electric equipment that may be connected to the battery 12, and it should be appreciated that any desired electric equipment may be powered by the battery 12 through the primary circuit 18.

The electric vehicle 10 includes a manual disconnect, indicated generally at 20. The manual disconnect 20 allows a technician to open the primary circuit 18 at the battery 12, for example, when the electric motor 14 is to be serviced. It should be appreciated that the primary circuit 18 is only described in a simplified form sufficient for the understanding of the manual disconnect 20. The preferred embodiment of the invention will be described in connection with the battery 12 on the electric vehicle 10, but it should be appreciated that the invention may be used as an electric disconnect in any desired circuit.

The manual disconnect 20 includes a base 24 that is mounted to the battery 12 and a plug assembly, indicated generally at 26. The plug assembly 26 may be moved relative to the base 24 between a connected position and a disconnected position. The plug assembly 26 includes a fuse 28. When the plug assembly 26 is in the connected position relative to the base 24, current flow through the primary circuit 18 passes through the fuse 28. When the plug assembly 26 is disconnected from the base 24, the primary circuit 18 is open.

The manual disconnect 20 also includes an interlock resistor 30. The interlock resistor 30 is part of an interlock loop, indicated generally at 32. The interlock loop 32 is an electric circuit that is closed when the plug assembly 26 is connected to the base 24, and is opened when the plug assembly 26 is disconnected from the base 24. A battery control 34 monitors the status of the interlock loop 32. If the interlock loop 32 is opened, the battery control 34 shuts down electric current flow through the primary circuit 18.

Figure 2:
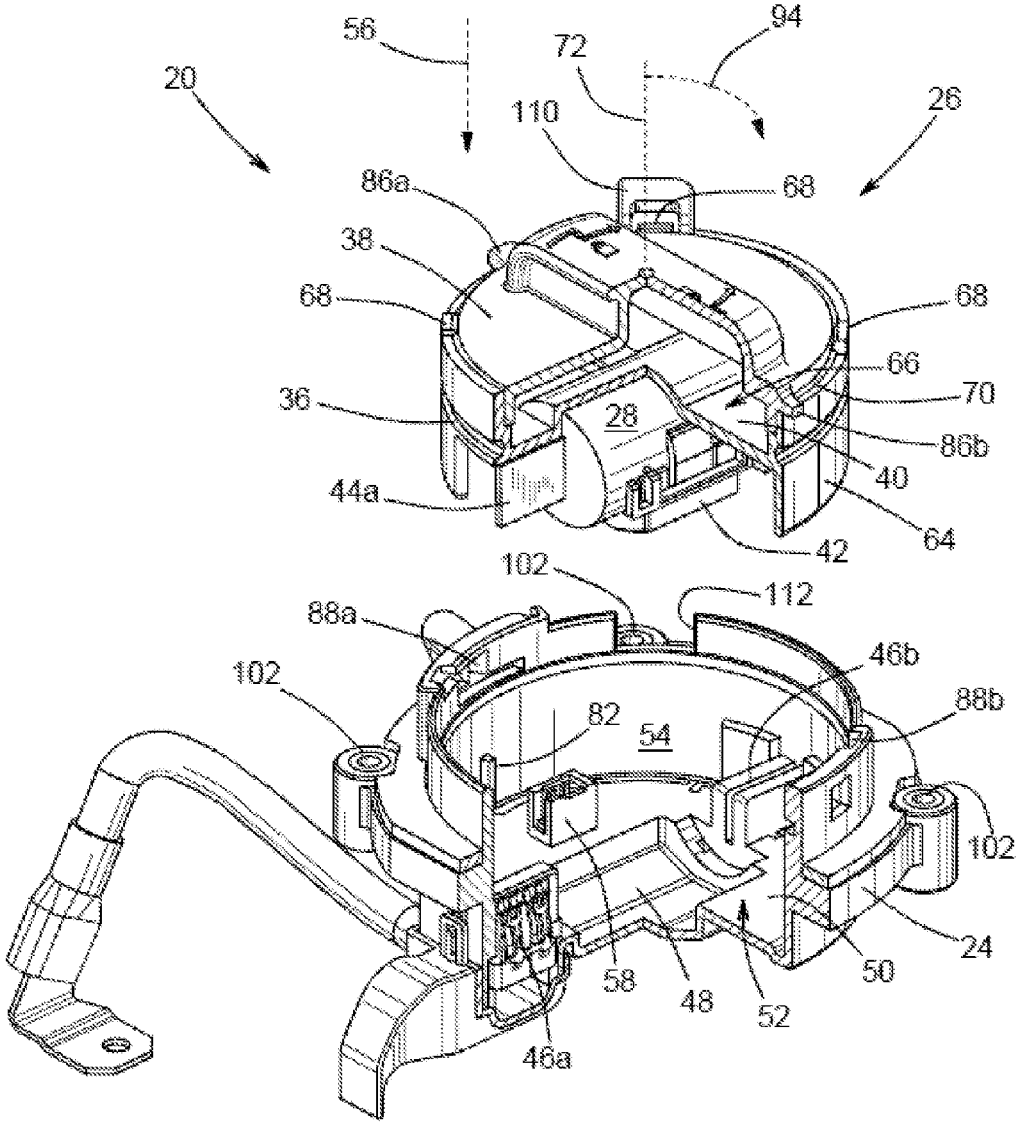
FIG. 2 is a partially cut-away, perspective view of the manual disconnect, showing a base and a plug assembly in a disconnected position.

Referring now to FIG. 2, a perspective view of the manual disconnect 20 is shown, partially cut-away so that internal components are visible. In FIG. 2, the plug assembly 26 is shown disconnected from the base 24 and both the primary circuit 18 and the interlock loop 32 are open.

Figure 3:
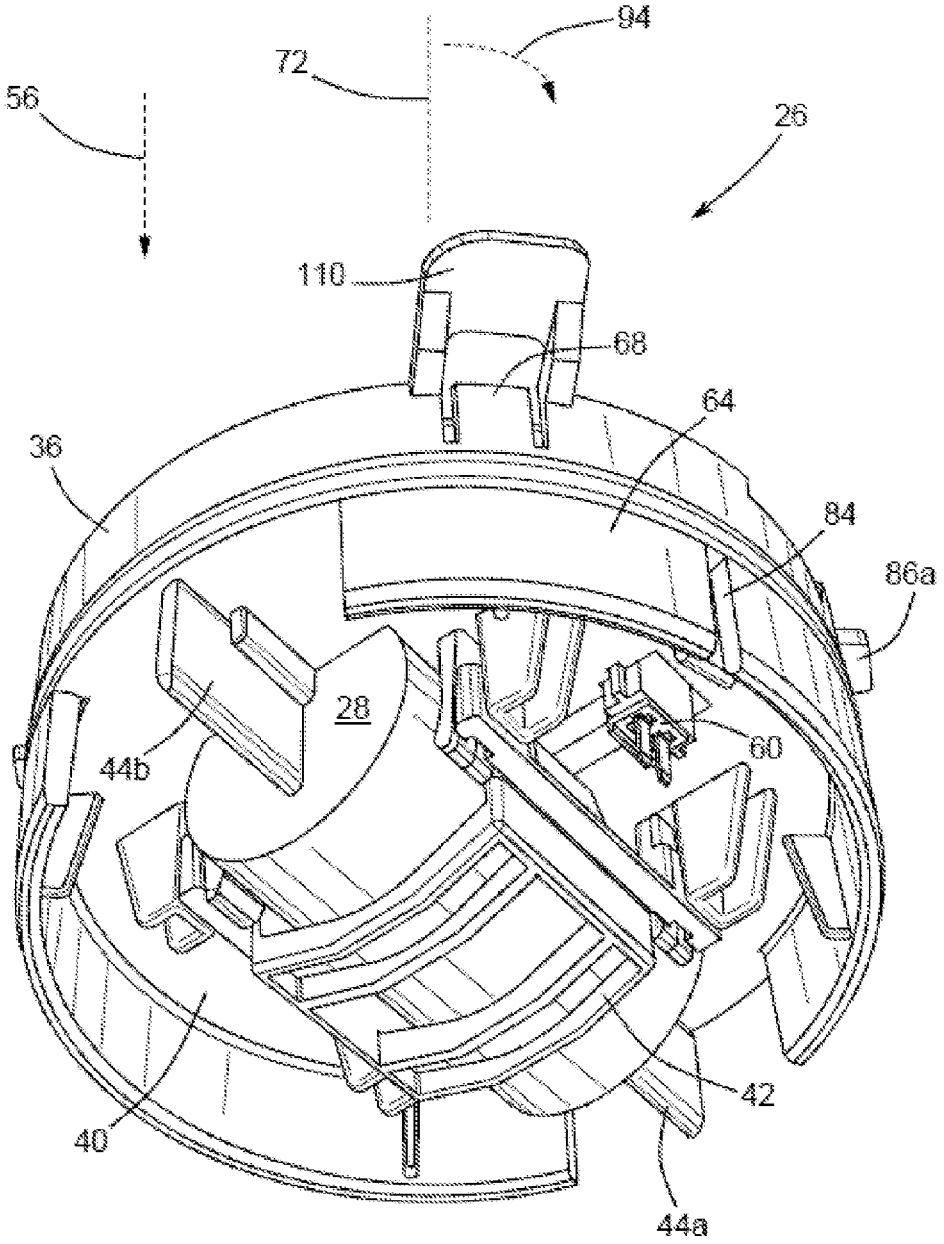
FIG. 3 is a perspective view, from below, of the plug assembly.

The plug assembly 26 includes a plug housing 36 and a handle 38. The illustrated plug housing 36 and the illustrated handle 38 are both molded from plastic, but may be made of any other desired materials. The handle 38 is connected to the plug housing 36 for relative rotational movement, as will be described below. Referring to FIG. 3, a perspective view, from below, of the plug assembly 26 is shown. The fuse 28 is connected to a plug housing surface 40 by a fuse retainer 42. The illustrated fuse retainer 42 is a separate plastic piece that snap-fits to the plug housing 36 and retains the fuse 28 therebetween. However, the fuse 28 may be retained on the plug assembly 26 by any other desired fastener. The illustrated fuse 28 includes two fuse terminals, 44*a* and 44*b*. The illustrated fuse terminals 44*a* and 44*b* are male blade terminals, but they may be any desired type of electric terminal.

Referring back to FIG. 2, the base 24 includes two primary terminals, 46*a* and 46*b*. The illustrated primary terminals 46*a* and 46*b* are female terminals, but may be any desired electric terminal. The base 24 also includes a fuse cradle 48 defined in a base surface 50. As will be described below, when the plug assembly 26 is connected to the base 24, the primary terminals 46*a* and 46*b* engage the respective fuse terminals 44*a* and 44*b*. Additionally, portions of the fuse 28 and the fuse retainer 42 are located in the fuse cradle 48.

Figure 4:
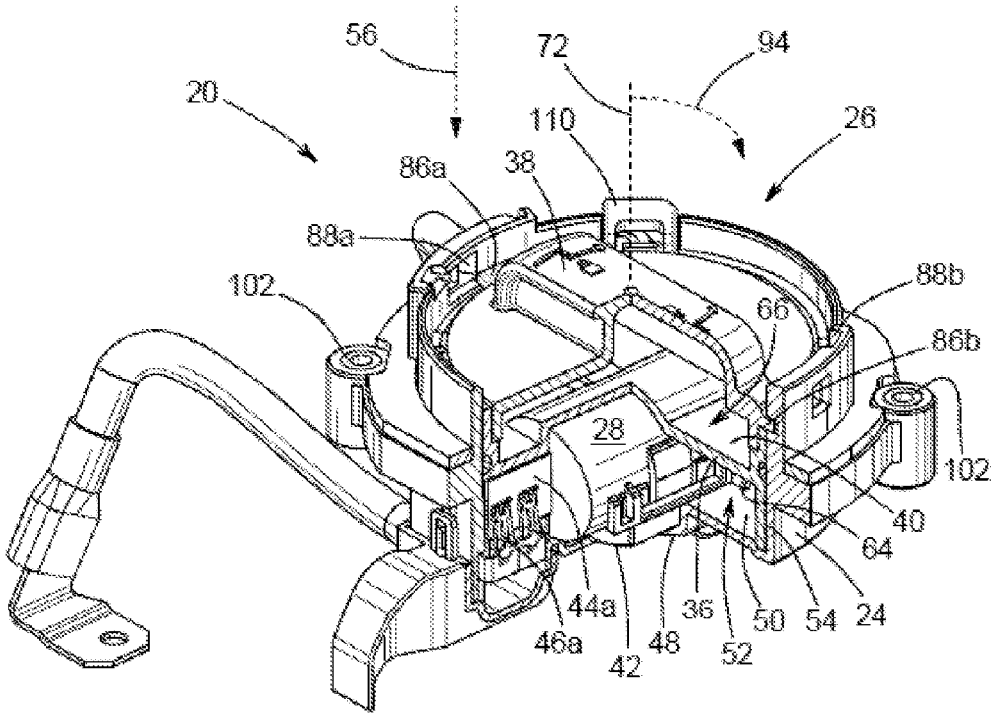
FIG. 4 is a view similar to that of FIG. 2, showing the manual disconnect in a connected position.

Referring to FIG. 4, a cut-away perspective view similar to FIG. 2 is shown, with the plug assembly 26 connected to the base 24. The plug assembly 26 is connected to the base 24 by inserting the plug assembly 26 into a base space, indicated generally at 52, defined by a base side wall 54. The plug assembly 26 is inserted into the base space 52 in an insertion direction 56. As shown, the fuse terminal 44*a* is engaged by the primary terminal 46*a*. Although not visible in FIG. 4, it should be appreciated that the fuse terminal 44*b* is engaged by the primary terminal 46*b*. With the fuse terminals 44*a* and 44*b* engaged by the respective primary terminals 46*a* and 46*b*, the primary circuit 18 is closed and the battery 12 is able to provide electric current to the electric motor 14.

Figure 5:
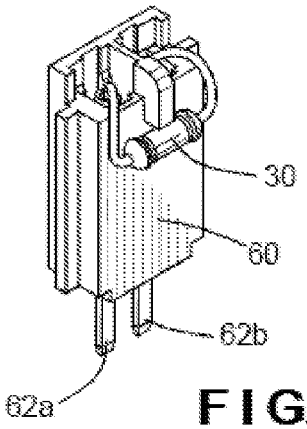
FIG. 5 is perspective view of an interlock resistor assembly of the manual disconnect.

As previously described in reference to FIG. 1, the manual disconnect 20 also includes part of an interlock loop 32. The interlock loop 32 is an electric circuit that is closed when the plug assembly 26 is connected to the base 24, and is opened when the plug assembly 26 is disconnected from the base 24. Referring to FIG. 2, the base 24 includes a base interlock connector 58. Referring to FIG. 3, the plug assembly 26 includes a complementary interlock resistor assembly 60. As best seen in FIG. 5, the interlock resistor assembly 60 includes the interlock resistor 30 connected between two resistor terminals 62*a* and 62*b*. The illustrated resistor terminals 62*a* and 62*b* are male blade terminals, but may be any desired electric terminal. The base interlock connector 58 includes two complementary terminals (not shown) that engage the resistor terminals 62*a* and 62*b* to close the interlock loop 32, as will be described below.

Figure 6:
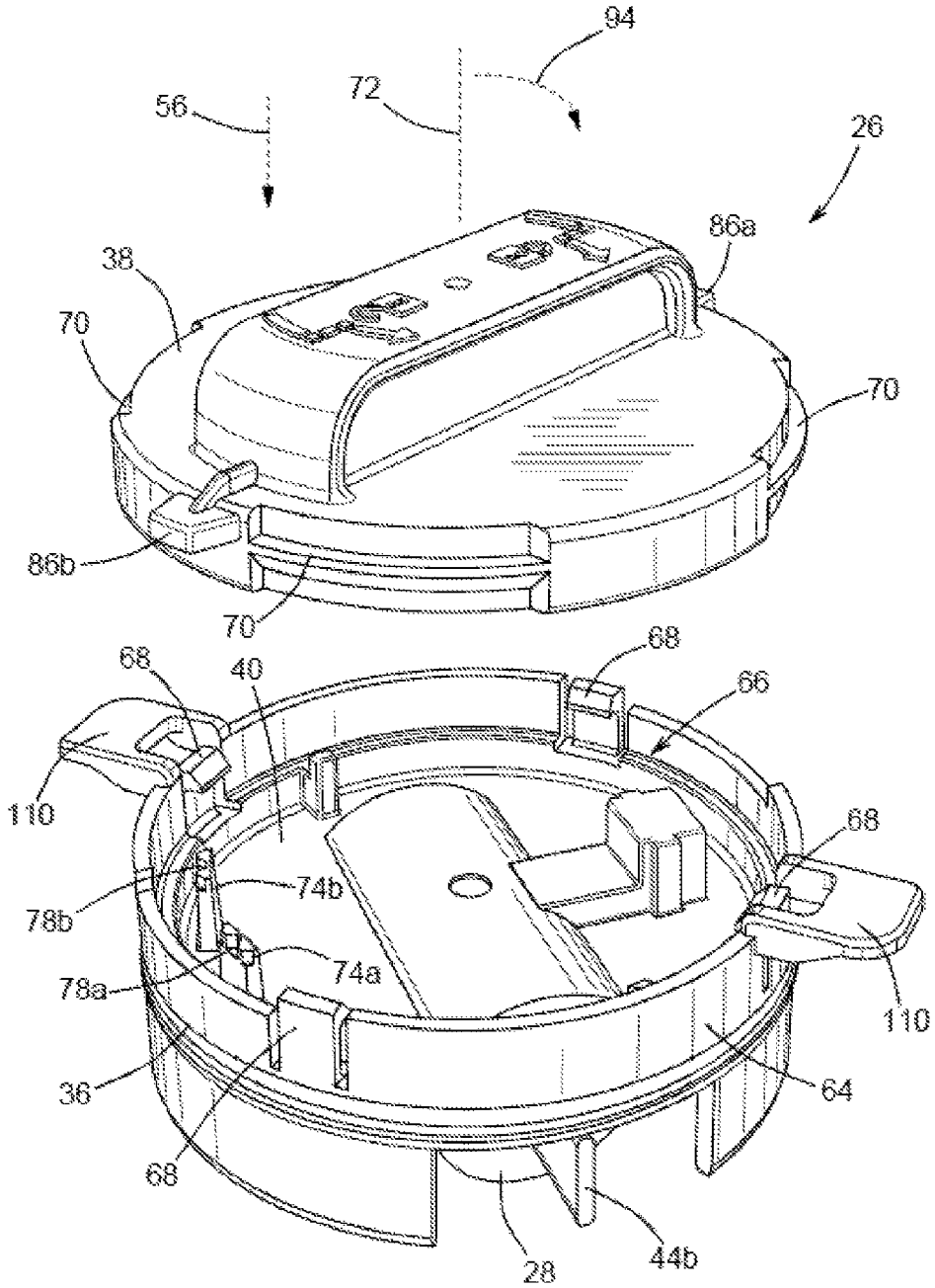
FIG. 6 is a perspective view of the plug assembly, showing a plug housing and a handle separated.

The process of connecting the plug assembly 26 to the base 24 will now be described in detail. As previously described, the plug assembly 26 includes the plug housing 36 and the handle 38. FIG. 6 is a perspective view showing the handle 38 separated from the plug housing 36. The illustrated plug housing 36 includes a plug housing side wall 64 that defines a handle space, indicated at 66. The illustrated plug housing 36 includes four resilient hooks 68 that project into the handle space 66. The illustrated handle 38 defines four handle slots 70. The illustrated handle 38 may be inserted into the handle space 66 by moving the handle 38 in the insertion direction 56 relative to the plug housing 36. The resilient hooks 68 are initially deflected by the handle 38, and then rebound to the engage the handle 38. Each of the resilient hooks 68 is then located in one of the handle slots 70, and the handle 38 is able to rotate relative to the plug housing 36 about a rotation axis 72 that is parallel to the insertion direction 56. It should be appreciated that the amount of relative rotation between the handle 38 and the plug housing 36 is limited by the length of the handle slots 70.

Figure 7:
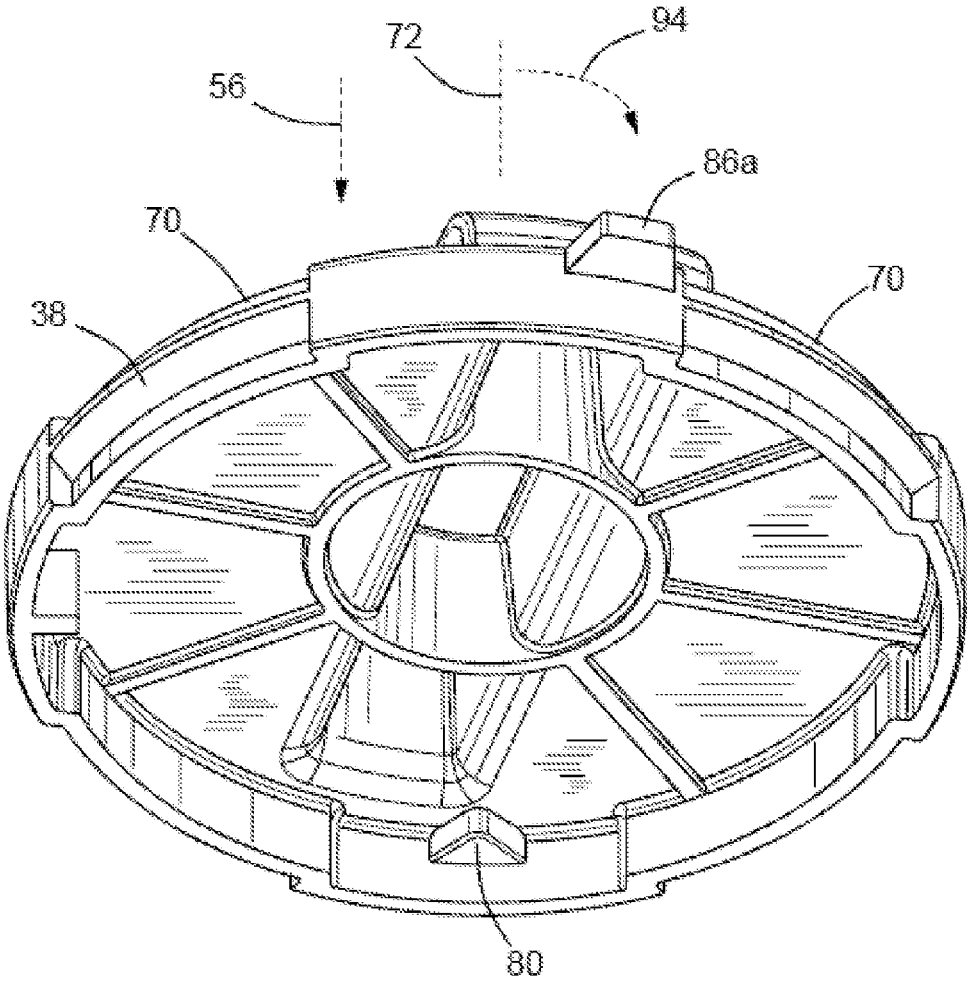
FIG. 7 is a perspective view, from below, of the handle.

The plug housing 36 also includes a pair of resilient stops, 74*a* and 74*b*, that extend from the plug housing surface 40. The illustrated resilient stops 74*a* and 74*b* are integrally molded with the plug housing surface 40, but may be made separately, if desired. The resilient stops 74*a* and 74*b* define respective V-shaped notches 78*a* and 78*b*. Referring to FIG. 7, a perspective view from below of the handle 38 is shown. The handle 38 includes a V-shaped finger 80 extending from the underside thereof. As will be described below, the resilient stops 74*a* and 74*b* and the finger 80 cooperate to provide the technician with a tactile indication of when the handle 38 is in one of two positions relative to the plug housing 36. It should be appreciated that the handle may include a resilient stop and the plug housing may include two cooperating fingers, if desired.

The resilient stops 74*a* and 74*b* and the finger 80 are arranged so that as the handle 38 is rotated relative to the plug housing 36, the finger 80 will first engage one of the resilient stops 74*a* and 74*b* and deflect it. As the handle 38 is further rotated relative to the plug housing 36, the engaged resilient stop 74*a* and 74*b* will rebound and the finger 80 will be engaged within the respective notch 78*a* and 78*b*. To rotate the handle 38 further relative to the plug housing 36, the technician will have to apply sufficient force to deflect the resilient stop 74*a* and 74*b*. Thus, the technician will be able to feel when the finger 80 is engaged with the notches 78*a* and 78*b*. When the finger 80 is engaged with notch 78*a*, the handle 38 is in an insertion position relative to the plug housing 36. When the finger 80 is engaged with the notch 78*b*, the handle 38 is in a locked position relative to the plug housing 36. The significance of these two positions will be described below.

Referring back to FIG. 2, the handle 38 is engaged with and is in the insertion position relative to the plug housing 36. The assembled plug assembly 26 is then moved in the insertion direction 56 relative to the base 24 in order to close the primary circuit 18. The illustrated base 24 includes an optional base guide 82. The illustrated base guide 82 is a projection from the base side wall 54 that extends into the base space 52. The plug assembly 26 includes a complementary plug guide 84, shown in FIG. 3. The illustrated plug guide 84 is a slot defined by the plug housing side wall 64. When the plug assembly 26 is inserted into the base space 52, the plug housing side wall 64 will engage the projection 82 and prevent movement of the plug assembly 26 in the insertion direction 56 unless the slot 84 is aligned with the projection 82. Thus, the base guide 82 and the plug guide 84 cooperate to ensure that the plug assembly 26 is properly aligned with the base 24 during insertion of the service plug 26 into the base 24. It should be appreciated that the illustrated base guide 82 and plug guide 84 may be replaced with any desired cooperating guides.

The illustrated plug assembly 26 includes two lock tabs 86*a* and 86*b*. However, the plug assembly 26 may include a different desired number of lock tabs 86*a* and 86*b*. The illustrated lock tabs 86*a* and 86*b* are integrally molded with and extend from the handle 38. However, the lock tabs 86*a* and 86*b* may be separate components, if desired. As best seen in FIG. 2, the base 24 includes two lock channels 88*a* and 88*b* defined on the interior of the base side wall 54. It should be appreciated that, if desired, the plug assembly 26 may define the lock channels and the base may include the lock tabs.

Figure 8:
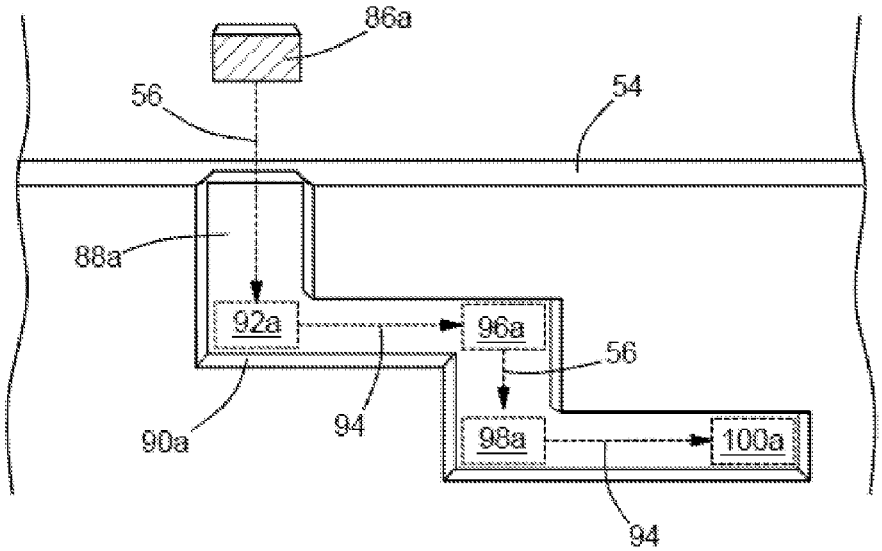
FIG. 8 is a profile side view of a lock channel of the base.

When the handle 38 is in the insertion position relative to the plug housing 36, the slot 84 is aligned with the projection 82, and the plug assembly 26 is moved in the insertion direction 56 relative to the base 24, the lock tabs 86*a* and 86*b* enter the respective lock channels 88*a* and 88*b*. A profile side view of the lock channel 88*a* is shown in FIG. 8. The plug assembly 26 may be moved in the insertion direction 56 until the lock tab 86*a* engages a channel wall 90*a*, which blocks further movement of the plug assembly 26 in the insertion direction 56. At this point, the lock tab 86*a* is at the location 92*a* and the plug assembly 26 is in a primary circuit engaged position relative to the base 24. In this position, the fuse terminals 44*a* and 44*b* are engaged by the respective primary terminals 46*a* and 46*b*, and the primary circuit 18 is closed.

From the primary circuit engaged position, the handle 38 may be rotated about the rotation axis 72 in a locking direction 94. It should be appreciated that the handle 38 is rotated relative to both the plug housing 36 and the base 24, while the plug housing 36 remains stationary relative to the base 24. The handle 38 may be rotated relative to the base 24 until the lock tab 86*a* is in the location 96*a*. In the illustrated embodiment, in order to move from location 92*a* to location 96*a* the handle 38 is rotated 15 degrees. However, these locations may be positions any desired amount of rotation apart.

From location 96*a*, the handle 38 may be moved further in the insertion direction 56. It should be appreciated that the plug assembly 26, including both the handle 38 and the plug housing 36, move in the insertion direction 56 relative to the base 24 until the lock tab 86*a* is in the location 98*a*. At this point, the plug assembly 26 is in an interlock position relative to the base 24. The fuse terminals 44*a* and 44*b* remain engaged by the respective primary terminals 46*a* and 46*b*, and the primary circuit 18 remains closed. Additionally, the base interlock connector 58 is engaged with the interlock resistor assembly 60 to close the interlock loop 32. At this point, the battery control 34 will allow electric current to flow through the primary circuit 18.

From the interlock position, the handle 38 may be rotated about the rotation axis 72 in the locking direction 94. It should be appreciated that the handle 38 is rotated relative to both the plug housing 36 and the base 24, while the plug housing 36 remains stationary relative to the base 24. The handle 38 may be rotated relative to the base 24 until the lock tab 86*a* is in the location 100*a*. In the illustrated embodiment, in order to move from location 98*a* to location 100*a*, the handle 38 is rotated 15 degrees. However, these locations may be positions any desired amount of rotation apart.

When the lock tab 86*a* is in the location 100*a*, the handle 38 is in the locked position relative to the plug housing 36. As previously described, the finger 80 is engaged with the notch 78*b*. At this position, the plug assembly 26 is fully connected to the base 24, and both the primary circuit 18 and the interlock loop 32 remain closed.

The above-described process for connecting the plug assembly 26 to the base 24 described the interaction between the lock tab 86*a* and the lock channel 88*a*. It should be appreciated that the lock tab 86*b* has a similar interaction with the lock channel 88*b*.

The previously-described process for connecting the plug assembly 26 to the base 24 may be reversed to disconnect the plug assembly 26 from the base 24. As was described, during connection of the plug assembly 26 to the base 24, the primary circuit 18 is closed first and the interlock loop 32 closed second. It should be appreciated that during disconnection of the plug assembly 26 from the base 24, the interlock loop 32 is opened first and the primary circuit 18 is opened second.

Figure 9:
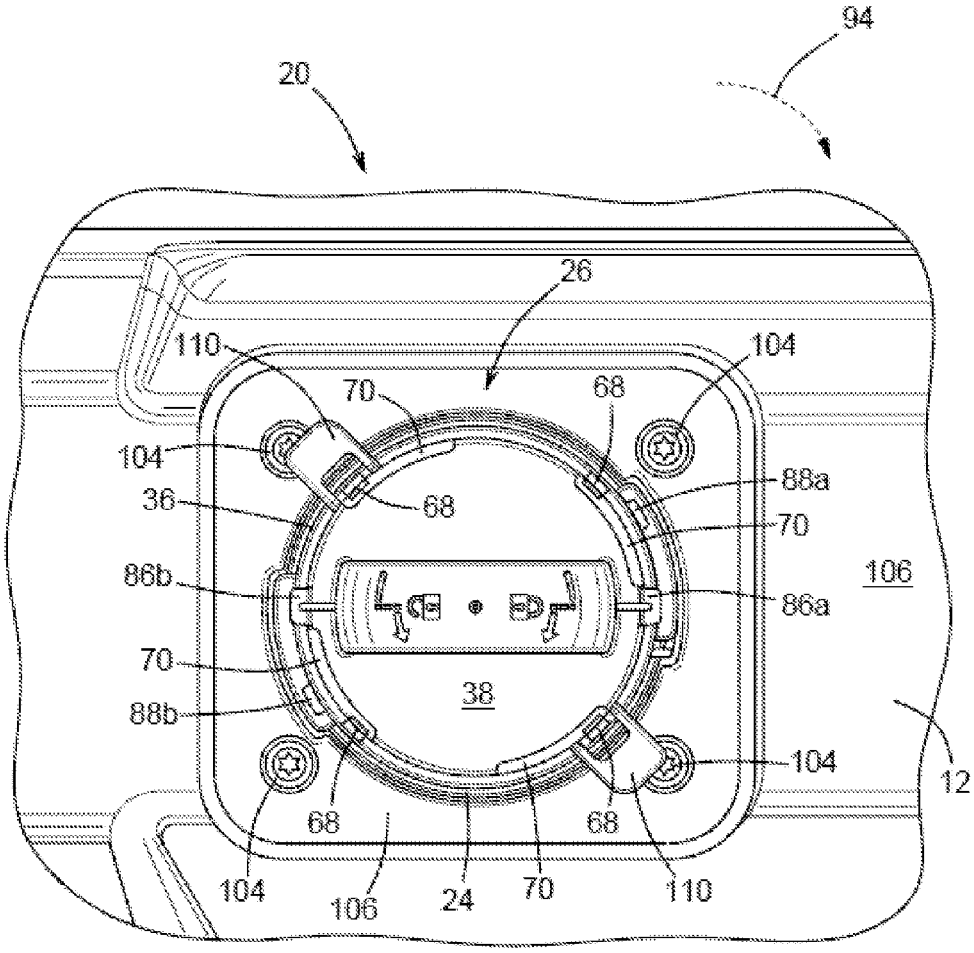
FIG. 9 is plan view, from above, of the manual disconnect with the plug assembly connected to the base.

Referring back to FIG. 2, the base 24 defines a plurality of mounting points 102. As shown in FIG. 9, the illustrated mounting points 102 are blind-holes that allow threaded connectors such as bolts 104 to be used to attach the base 24 to a housing 106 of the battery 12. The illustrated base 24 includes four mounting points 102, but may include any desired number of mounting points 102. Additionally, the base 24 may be attached to the housing 106 using any other desired fastener.

The illustrated plug assembly 26 includes optional bolt covers 110. The illustrated bolt covers 110 are projections from the plug housing 36. The bolt covers 110 prevent the manual disconnect 20 from being removed from the battery 12 without first removing the plug assembly 26 from the base 24. Referring to FIG. 2, one bolt cover 110 is shown (the second bolt cover is in the area cut-away), as well as a bolt cover slot 112 defined in the base side wall 54. When the plug assembly 26 is connected to the base 24, the bolt cover 110 is located in the bolt cover slot 112. Referring to FIG. 9, the bolt covers 110 are positioned in-line with some of the mounting points 102 and prevent the bolts 104 in those mounting points 102 from being removed from the housing 106. In order to remove the covered bolts 104 from the housing 106, the plug assembly 26 must first be removed from the base 24 in order to expose the bolts 104. As previously described, this will open both the interlock loop 32 and the primary circuit 18. Thus, the electric current from the battery 12 will be interrupted before the manual disconnect 20 can be removed from the battery 12.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A manual disconnect for an electric circuit, the manual disconnect comprising:

a housing;

a base attached to the housing by a fastener, the base including primary terminals;

an interlock connector;

an interlock resistor assembly; and a plug assembly including fuse terminals and a bolt cover, the plug assembly being movable relative to the base along an axis in an insertion direction between a disconnected position, wherein the fuse terminals are not engaged with respective primary terminals, and a primary circuit engaged position wherein the fuse terminals are engaged with respective primary terminals; and the plug assembly being rotatable about the axis relative to the base to move the plug assembly from the primary circuit engaged position to an interlock position, wherein the interlock connector is engaged with the interlock resistor assembly and the bolt cover is positioned to prevent the fastener from being removed from the housing.

2. The manual disconnect for an electric circuit of claim 1, wherein the insertion direction is parallel to the axis of rotation.

3. The manual disconnect for an electric circuit of claim 1, wherein the plug assembly includes a plug housing and a handle attached to for relative rotational movement.

4. The manual disconnect for an electric circuit of claim 3, wherein the handle is rotated about the axis relative to the base to move the plug assembly from the primary circuit engaged position to the interlock position.

5. The manual disconnect for an electric circuit of claim 4, wherein when the handle is rotated about the axis relative to the base, the plug housing is stationary relative to the base.

6. The manual disconnect for an electric circuit of claim 1, wherein the bolt cover comprises a tab attached to the plug assembly.

7. The manual disconnect for an electric circuit of claim 1, wherein the base is attached to the housing by a plurality of fasteners, and the plug assembly includes a plurality of bolt covers and when the plug assembly is in the primary circuit engaged position each of the plurality of bolt covers is positioned to prevent one of the plurality of fasteners from being removed from the housing.

8. A manual disconnect for an electric circuit comprising:

a housing;

a base attached to the housing by a fastener, the base including primary terminals;

an interlock connector;

an interlock resistor; and a plug assembly including fuse terminals, a handle, and a bolt cover, the plug assembly is movable in an insertion direction relative to the base between a disconnected position wherein the fuse terminals are not engaged with respective primary terminals and a primary circuit engaged position wherein the fuse terminals are engaged with respective primary terminals, wherein:

the plug housing is further movable relative to the base to an interlock position, the interlock connector is engaged with the interlock resistor assembly, and the bolt cover is positioned to prevent the fastener from being removed from the housing.

9. The manual disconnect for an electric circuit of claim 8, wherein the plug assembly includes a handle attached to the plug housing for relative rotational movement thereof.

10. The manual disconnect for an electric circuit of claim 9, wherein the handle is rotated about an axis relative to the base to move the plug assembly from the primary circuit engaged position to the interlock position.

11. The manual disconnect for an electric circuit of claim 10, wherein when the handle is rotated about an axis relative to the base, the plug housing is stationary relative to the base.

* * * * *